US007063135B2

(12) United States Patent
Takahashi et al.

(10) Patent No.: US 7,063,135 B2
(45) Date of Patent: Jun. 20, 2006

(54) HEAT EXCHANGER

(75) Inventors: Torahide Takahashi, Tatebayashi (JP); Yoshihiro Sasaki, Sano (JP); Takashi Fujita, Sano (JP)

(73) Assignee: Calsonic Kansei Corporation, Tokyo (JP)

( * ) Notice: Subject to any disclaimer, the term of this patent is extended or adjusted under 35 U.S.C. 154(b) by 81 days.

(21) Appl. No.: 10/808,139

(22) Filed: Mar. 24, 2004

(65) Prior Publication Data

US 2004/0244957 A1 Dec. 9, 2004

(30) Foreign Application Priority Data

Mar. 26, 2003 (JP) ..... 2003-085291

(51) Int. Cl.
*F28F 9/02* (2006.01)

(52) U.S. Cl. ..... 165/178; 165/173; 165/175

(58) Field of Classification Search ..... 165/173–176, 165/178

See application file for complete search history.

(56) References Cited

U.S. PATENT DOCUMENTS 5,152,339 A * 10/1992 Calleson ..... 165/173
5,911,274 A * 6/1999 Inaba et al. ..... 165/178
6,340,055 B1 * 1/2002 Yamauchi et al. ..... 165/174
6,564,863 B1 * 5/2003 Martins ..... 165/175
6,604,574 B1 * 8/2003 Loomis et al. ..... 165/173
6,854,512 B1 * 2/2005 Lee et al. ..... 165/174

FOREIGN PATENT DOCUMENTS

JP 11-325784 11/1999

* cited by examiner

*Primary Examiner*—Teresa J. Walberg
(74) *Attorney, Agent, or Firm*—Kilpatrick Stockton LLP

(57) ABSTRACT

A heat exchanger includes a plurality of tubes, a pair of header pipes, partition walls, an inlet connector block and an outlet connector block. The plurality of tubes have one ends connected to one header pipe and other ends connected to the other header pipe. The header pipe internally has a pipe-inside flow-through bore. The partition wall is internally formed in each header pipe to divide the pipe-inside flow-through bore into two regions. Each header pipe has a block connector bore opening at an outer side wall opposing to an area to which the tubes are connected and opening to the pipe-inside flow-though bore by cutting out a portion of the partition wall. The inlet connector block is connected to the block connector bore of one header pipe to admit coolant to flow in. The outlet connector block is connected to the block connector bore of the other header pipe to permit coolant to flow out.

12 Claims, 12 Drawing Sheets

HEAT EXCHANGER

CROSS REFERENCE TO RELATED APPLICATIONS

This application claims benefit of priority under 35 U.S.C § 119 to Japanese Patent Application No. 2003-85291, filed on Mar. 26, 2003, the entire contents of which are incorporated by reference herein.

BACKGROUND OF THE INVENTION

1. Field of the Invention

The present invention relates to a heat exchanger that has tubes, header pipes, an inlet connector block and an outlet connector block.

2. Description of the Related Art

Two heat exchangers are disclosed in Japanese Patent Provisional Publication No. 11-325784. As shown in FIG. 1, the former heat exchanger 50 is comprised of tubes 51, corrugated fins 52, header pipes 53, 53, an inlet connector block 54 and an outlet connector block 55. The plural tubes 51 are disposed in spaced relationship with respect to one another. The plural corrugated fins 52 are disposed between adjacent tubes 51. The header pipes 53, 53 are connected to both ends of each tube 51. The inlet connector block 54 is fixedly secured to one header pipe 53. The outlet connector block 55 is fixedly secured to the other header pipe 53.

First fluid (coolant) enters from the inlet connector tube 54 and flows through a given flow path including one header pipe 53, the plural tubes 51, the other header pipe 53 in this order. First fluid efficiently heat-exchanges with second fluid flowing outside of the tubes.

Next, a connecting structure between one header pipe 53 and the inlet connector block 54 of the heat exchanger 50 is described. As shown in FIG. 2, a partition wall 56 is formed in the header pipe 53 along a longitudinal direction thereof, dividing an interior of the header pipe 53 into pipe-inside flow-through bores 57*a*, 57*b*. The partition wall 56 provides an increased compressive strength. Also, an internal communicating bore 59 is formed in the partition wall 56 to allow the pipe-inside flow-through bores 57*a*, 57*b* to communicate with one another. Formed on an outer peripheral surface of the header pipe 53 is a block connector bore 58 that is open to the pipe-inside flow-through bore 57*a*. A distal end of an in-pipe 54*a* of the inlet connector block 54 is inserted to the block connector bore 58 and fixedly connected thereto.

First fluid flows from the inlet connector block 54 into the pipe-inside flow-through bore 57*a* and then enters to the pipe-inside flow-through bore 57*b* through the internal communicating bore 59. With such a structure, first fluid is distributed and supplied from the inlet connector block 54 to the pipe-inside flow-through bores 57*a*, 57*b* formed inside the header pipe 53. A flow distribution ratio of first fluid to be distributed to the pipe-inside flow-through bores 57*a*, 57*b* varies depending upon a ratio between a diameter A of the block connector bore 58 and a diameter B of the internal communicating bore 59. Also, the other header pipe 53 and the outlet connector block 55 have the same connecting mechanism as that of one header pipe 53 and the inlet connector block 54.

As the latter heat exchanger, as shown in FIG. 3, the latter heat exchanger 60 is comprised of tubes 61, corrugated fins 62, header pipes 63, 63, an inlet connector block 64 and an outlet connector block 65.

The plural tubes 61 are disposed in spaced relationship with respect to one another. The plural corrugated fins 62 are disposed between adjacent tubes 61. The header pipes 63, 63 are connected to both ends of each tube 61. The inlet connector block 64 is fixedly secured to one header pipe 63. The outlet connector block 65 is fixedly secured to the other header pipe 63.

Next, a connecting structure between one header pipe 63 and the inlet connector block 64 of the heat exchanger 50 in the heat exchanger 60 is described. As shown in FIG. 4B, a partition wall 66 is formed in the header pipe 63 along a longitudinal direction thereof, dividing an interior of the header pipe 63 into pipe-inside flow-through bores 67*a*, 67*b*. The partition wall 66 provides an increased compressive strength. As shown in FIG. 4C, an outer peripheral wall of the header pipe 63 is formed with block connector bores 68*a*, 68*b* that are open to the pipe-inside flow-through bores 67*a*, 67*b*, respectively. As shown in FIG. 4A, the inlet connector block 64 has branch pipes 64*b*, 64*c* each of which has one end connected to an in-pipe 64*a*. The branch pipes 64*b*, 64*c* are inserted to and fixed to the block connector bores 68*a*, 68*b*, respectively.

First fluid flows from the branch pipes 64*b*, 64*c* of the inlet connector block 64 into the pipe-inside flow-through bores 67*a*, 67*b*, respectively. With such a structure, first fluid is distributed and supplied from the inlet connector block 64 to the pipe-inside flow-through bores 67*a*, 67*b* formed inside the header pipe 63. A flow distribution ratio of first fluid to be distributed to the pipe-inside through-bores 67*a*, 67*b* varies depending upon an internal diameter ratio between the branch pipes 64*b*, 64*c*. Also, the other header pipe 63 and the outlet connector block 65 have the same connecting mechanism as that of one header pipe 63 and the inlet connector block 64.

The former heat exchanger has the following problems: With the heat exchanger 50, since the internal communicating bore 59 is formed inside the header pipe 53, it becomes hard to conduct work for machining the heat exchanger 50. Also, in order to vary the flow distribution ratio of first fluid to be distributed to the pipe-inside flow-through bores 57*a*, 57*b*, there is a need for changing the diameter A of the block connector bore 58 and the diameter B of the internal communicating bore 59, and it becomes hard to conduct work for machining the heat exchanger 50.

The latter heat exchanger has the following problems: With the heat exchanger 60, since the block connector bores 68*a*, 68*b* are formed on the outer peripheral wall of the header pipe 63, it becomes hard to conduct work for machining the heat exchanger 60. Also, in order to vary the flow distribution ratio of first fluid to be distributed to the pipe-inside flow-through bores 67*a*, 67*b*, there is a need for changing the internal diameter ratio between the block connector bores 58*a*, 58*b* and it becomes hard to conduct work for machining the heat exchanger 60.

SUMMARY OF THE INVENTION

It is therefore an object of the present invention to provide a heat exchanger that makes it possible to simplify a connecting stricture between a header pipe and an inlet connector block and a connecting structure between the header pipe and an outlet connector block while enabling to easily vary a flow distribution ratio of fluid to be distributed to a pair of pipe-inside flow-through bores.

To achieve the above object, the present invention provides a heat exchanger comprising: a plurality of tubes internally having tube-inside flow-through bores; a first header pipe comprising: a first partition wall that is internally formed; a first pipe-inside flow-through bore portion that is internally formed and divided into two regions by the first partition wall; and a first tube insertion bore portion formed on a first area of a side wall in slit shapes to accommodate first end portions of the tubes; a second header pipe comprising: a second partition wall that is internally formed; a second pipe-inside flow-through bore portion that is internally formed and divided into two regions by the second partition wall; and a second tube insertion bore portion formed on a first area of a side wall in slit shapes to accommodate second end portions of the tubes; a first connector bore portion formed on the side wall of the first header pipe at a second area opposing to the first area and on the first partition wall at an area opposing to the second area, and opening to the two regions of the first pipe-inside flow-though bore portion; a second connector bore portion formed on the side wall of the second header pipe at a second area opposing to the first area and on the second partition wall at an area opposing to the second area, and opening to the two regions of the second pipe-inside flow-though bore portion; an inlet connector block having one end portion accommodated in the first connector bore portion and permitting coolant to flow through the first pipe-inside flow-through bore portion; and an outlet connector block having one end portion accommodated in the second connector bore portion and permitting the coolant to flow out through the second pipe-inside flow-through bore portion.

According to the present invention, since the first connector bore portion is open to the first pipe-inside flow-through bore, the first header pipe may be provided with one connector bore portion. Further, since the second connector bore portion is open to the second connector bore portion, the second header portion may be provided with one connector bore portion. Therefore, the connecting structure between the header pipe and the inlet connector block and the connecting structure between the header pipe and the outlet connector block are simplified. Additionally, depending upon an installed position of the first connector bore portion, the surface area of the first in-pipe flow-through bore portion that is open to the two regions varies. Also, depending upon the position of the second connector bore portion, the surface area of the second in-pipe flow-through bore portion that is open to the two regions varies. Therefore, it becomes possible to easily vary the ratio of coolant to be distributed to the two regions of the pipe-inside flow-through bores.

DESCRIPTION OF THE PREFERRED EMBODIMENTS

Referring now to FIGS. 5 to 13, heat exchangers of first and second embodiments of the present invention are described.

First Embodiment

Figure 1:
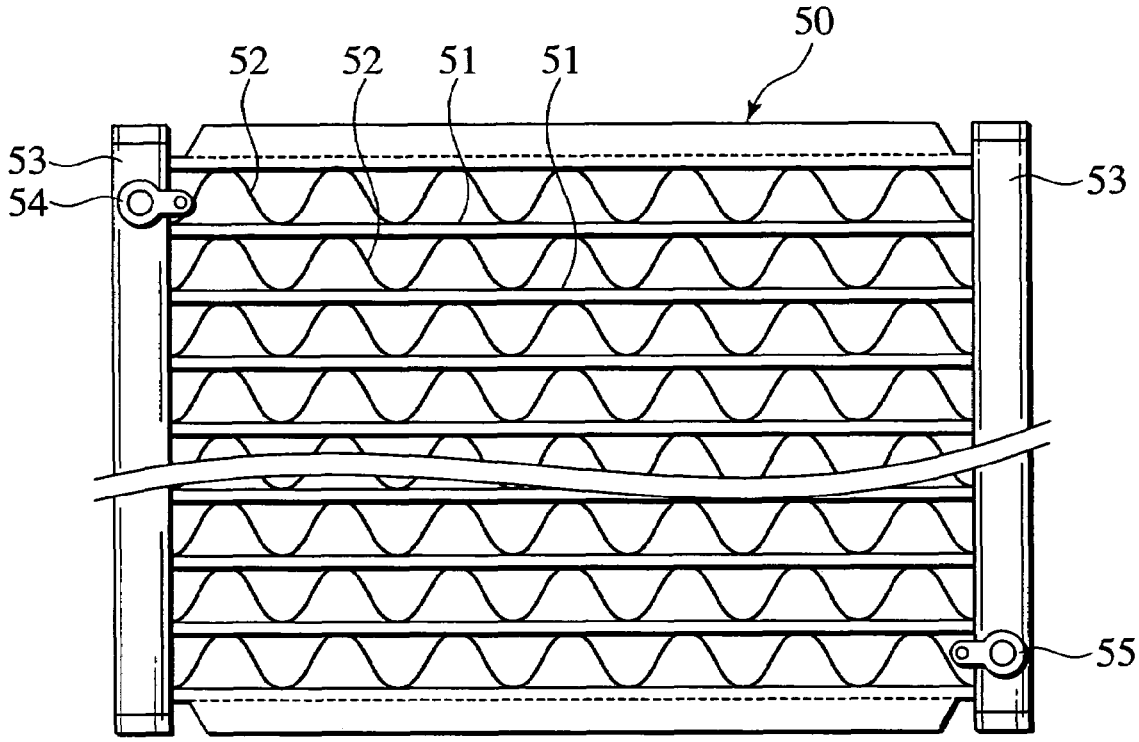
FIG.1 PRIOR ART
FIG. 1 is a cross sectional view of a heat exchanger of the related art.
Figure 2:
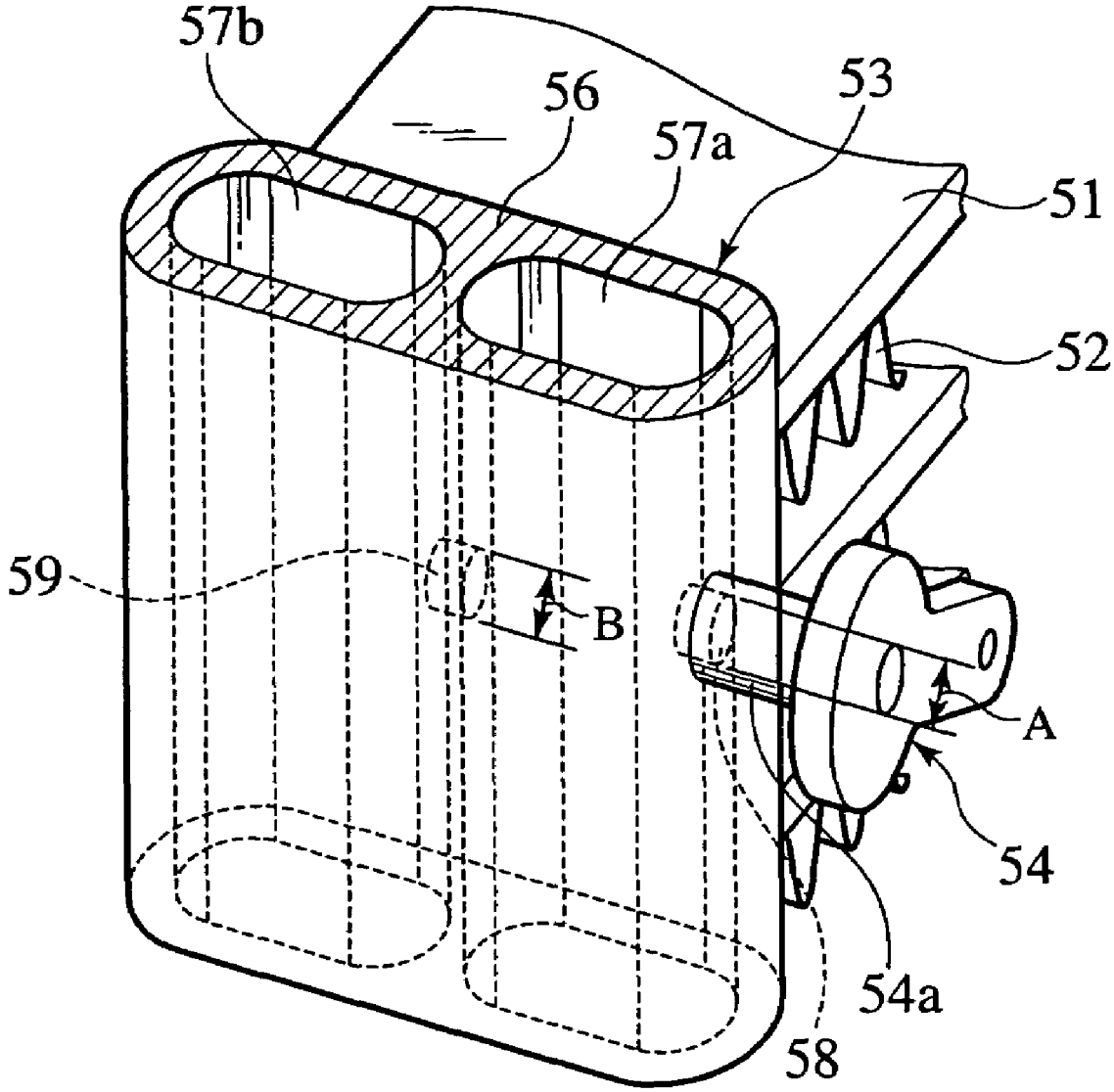
FIG.2 PRIOR ART
FIG. 2 is a perspective view of an essential part illustrating a connector portion between an inlet connector block and a header pipe in the heat exchanger of the related art.
Figure 3:
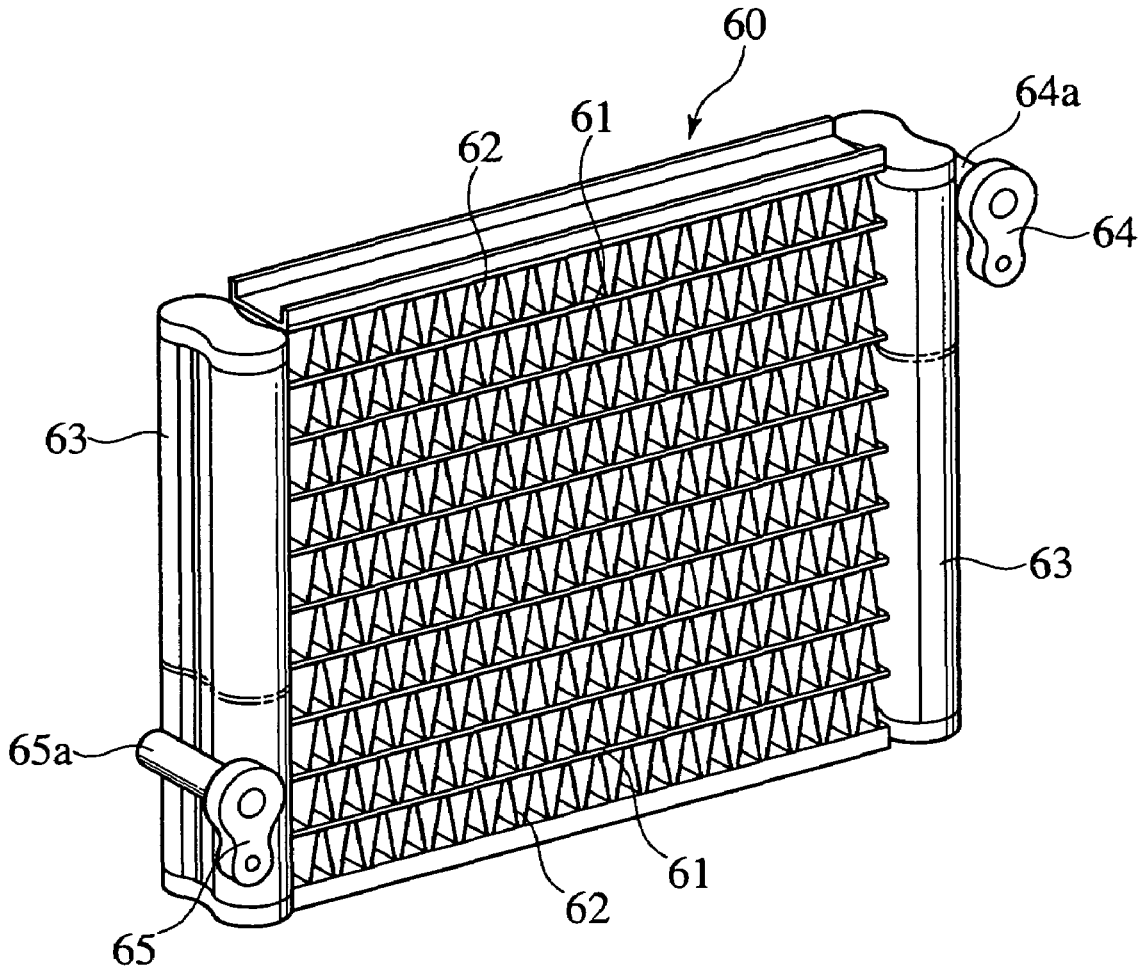
FIG.3 PRIOR ART
FIG. 3 is a perspective view of a heat exchanger of another related art.
Figure 4A:
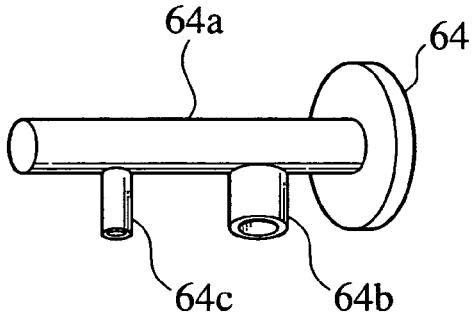
FIG.4A PRIOR ART
FIG. 4A is a perspective view of an in-pipe in a heat exchanger of another related art heat exchanger.
Figure 4B:
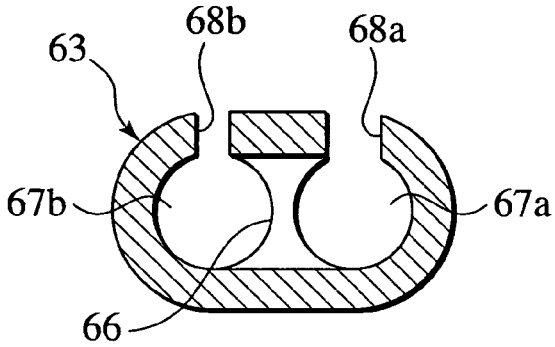
FIG.4B PRIOR ART
FIG. 4B is a cross sectional view of an essential part illustrating a header pipe in the heat exchanger of another related art.
Figure 4C:
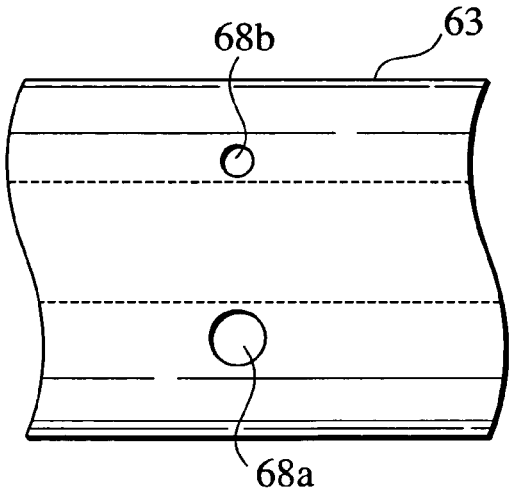
FIG.4C PRIOR ART
FIG. 4C is a front view of an essential part illustrating the header pipe in the heat exchanger of another related art.
Figure 5:
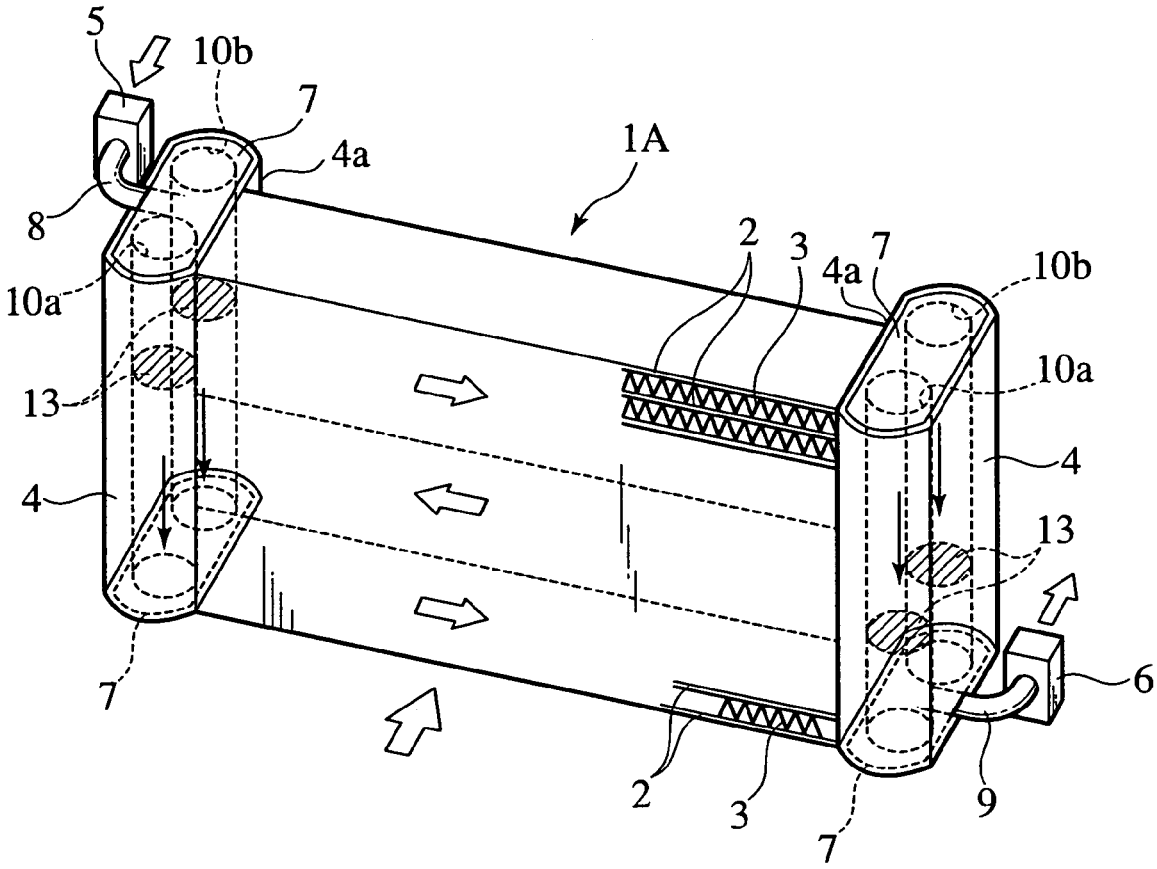
FIG. 5 is a perspective view of a heat exchanger of a first embodiment of the present invention.

As shown in FIG. 5, a heat exchanger 1A is comprised of tubes 2, corrugated fins 3, header pipes 4, an inlet connector block 5, an outlet connector block 6, and closure caps 7.

The plural tubes 2 are located in spaced relationship with respect to one another. Also, in FIG. 5, the plural tubes 2 are shown only in part. The plural corrugated fins 3 are disposed between adjacent tubes 2. Also, in FIG. 5, the plural corrugated fins 3 are shown only in part. The header pipes 4, 4 are connected to both ends of the respective tubes 2. The inlet connector block 5 is fixedly secured to one of the header pipes 4. The outlet connector block 6 is connected to the other header pipe 4. The closure caps 7 close both ends of the respective header pipes 4.

The tubes 2 are formed of, for instance, aluminum material in a flat plate configuration. Formed in each tube 2 are plural tube-inside flow-through bores (not shown) that extend in parallel with respect to one another. The tube-inside flow-through bores are opened at a distal end face 2*a* of the tube 2 (see FIGS. 7 and 8). The corrugated fins 3 are formed of aluminum material in corrugated shapes. The corrugated fins 3 are connected to adjacent tubes 2 by brazing.

The header pipes 4, 4 are made of, for instance, aluminum material. As shown in FIGS. 5 to 8, each header pipe 4 internally has pipe-inside flow-through bores 10*a*, 10*b*. A partition wall 11 is formed along a longitudinal direction of the header pipe 4, thereby dividing the header pipe 4 into the pipe-inside flow-through bores 10*a*, 10*b*. Formed on mutually opposing outer side walls 4*a*, 4*a* of the header pipes 4, 4 are plural tube insertion bores 4*c* that are formed along the longitudinal directions of the header pipes 4, 4 in slit-shapes in a substantially equidistantly spaced relationship. In each header pipe 4, the tube insertion bores 4*c* have ends opened to the pipe-inside flow-through bores 10*a*, 10*b*. The ends of the tube 2 are inserted to the tube insertion bores 4*c* and connected to the header pipes 4 by brazing. Partition plates 13, 13 are formed along short length directions of the header pipes 4, 4. Each partition plate 13 divides the pipe-inside flow-through bores 10*a*, 10*b* of the respective header pipes 4 in respective longitudinal length directions. With such a structure, first fluid (coolant) flow through the tubes 2 in zig zags along arrows shown in FIG. 5.

Figure 6:
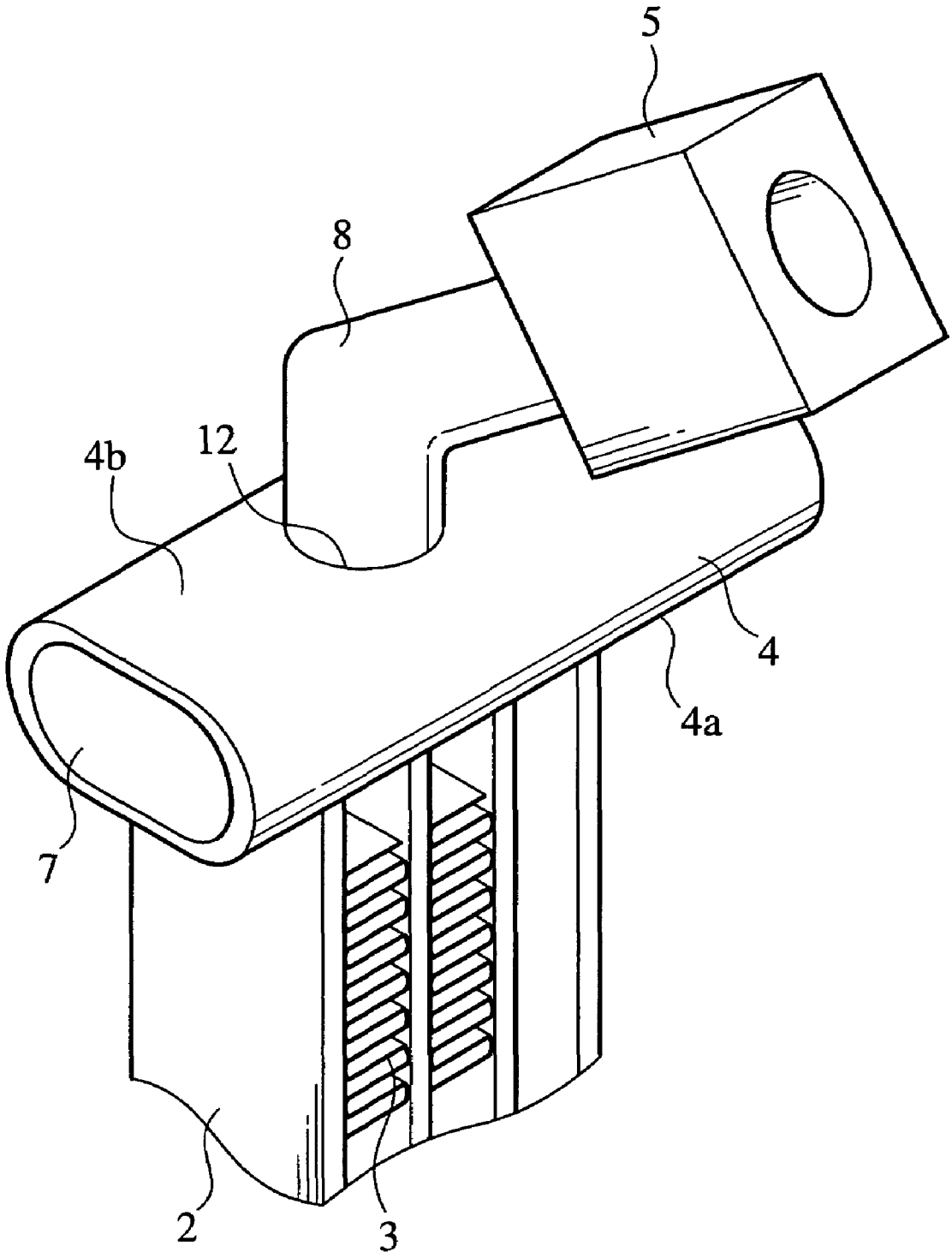
FIG. 6 is a perspective view of an essential part illustrating a connecting portion between an inlet connector block and a header pipe in the heat exchanger of the first embodiment of the present invention.
Figure 7:
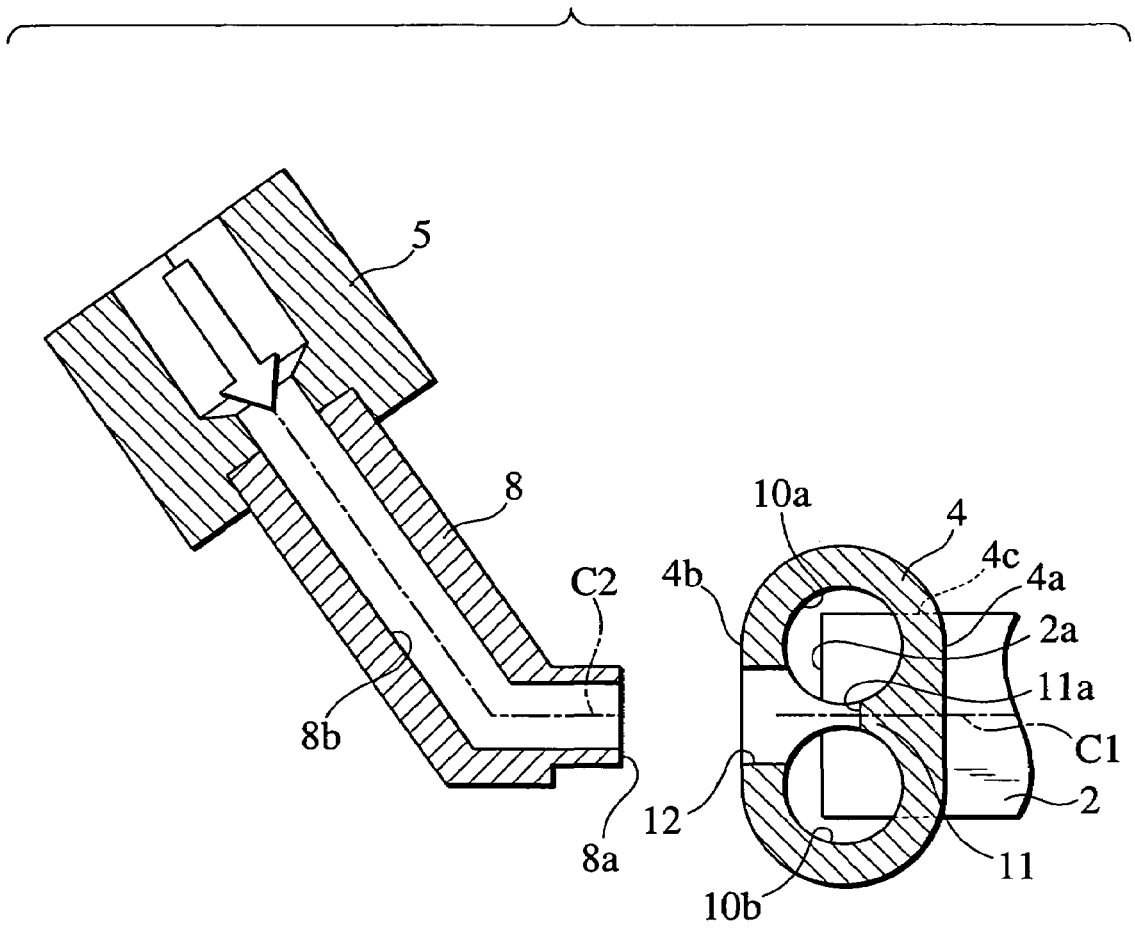
FIG. 7 is a cross sectional view illustrating a connecting portion between the inlet connector block and the header pipe in the heat exchanger of the first embodiment of the present invention.
Figure 8:
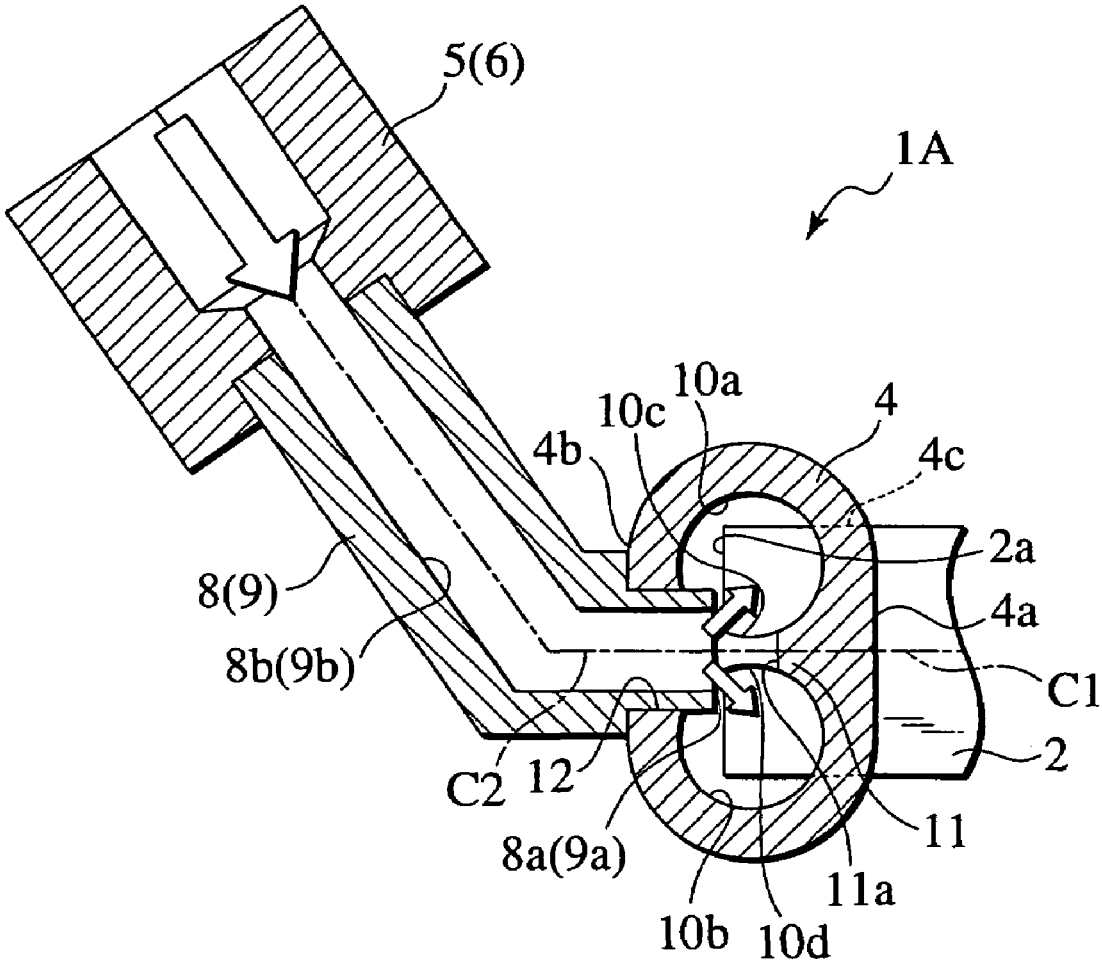
FIG. 8 is a cross sectional view illustrating a connecting portion between the inlet connector block and the header pipe in the heat exchanger of the first embodiment of the present invention.

Next, a connecting structure between the inlet connector block 5 and one header pipe 4 is described. As shown in FIGS. 6 to 8, cutting out portions of the outside wall 4*a* and the partition wall 11 at the outside wall 4*b* opposite to the outside wall 4*a* of the one header pipe 4 allows a block connector bore 12 to be formed. An end of the block connector bore 12 is open to the pipe-inside flow-through bores 10*a*, 10*b*. The block connector bore 12 has a cross section in a circular shape. The block connector bore 12 has a centerline in alignment with a centerline C1 of the partition wall 11. Inserting an in-pipe 8 of the inlet connector block 5 to the block connector bore 12 allows the inlet connector block 5 to be coupled to the header pipe 4. A communication bore 8*b* of the in-pipe 8 is formed in a circular cross section.

Under a condition where the inlet connector block 5 and the header pipe 4 are coupled to one another, a distal end surface 8*a* of the in-pipe 8 is inserted to the block connector bore 12 to a position in front of an end face 11*a* formed by cutting out the partition wall 11. The distal end surface 8*a* of the in-pipe 8 is open to the pipe-inside flow though bores 10*a*, 10*b*. The total surface area of open surfaces 10*c*, 10*d* of the pipe-inside flow-through bores 10*a*, 10*b* is nearly equal to a surface area of the distal end surface 8*a* of the in-pipe 8. A centerline C2 of the in-pipe 8 is aligned with the centerline C1 of the partition wall 11. A connecting structure between the outlet connector block 6 and the other head pipe 4 is similar to the connecting structure between the inlet connector block 5 and the one of the header pipes 4. That is, when described with reference to FIG. 8, cutting out portions of the outside wall 4*a* and the partition wall 11 at the outside wall 4*b* opposite to the outside wall 4*a* of the other header pipe 4 allows the block connector bore 12 to be formed. An end of the block connecting bore 12 is open to the pipe-inside flow-through bores 10*a*, 10*b*. The block connector bore 12 has the cross section in the circular shape. The block connector bore 12 has the centerline in alignment with the centerline C1 of the partition wall 11. Inserting an out-pipe 9 of the outlet connector block 6 to the block connector bore 12 allows the outlet connector block 6 to be coupled to the header pipe 4. A communication bore 9*b* of the out-pipe 9 is formed in a circular cross section.

With the heat exchanger 1A, first fluid (coolant) flows through a given path in a sequence through the inlet connector block 5, the pipe-inside flow-through bores 10*a*, 10*b* of one of the header pipes 4, tube-inside flow-through bores of plural tubes 2, the pipe-inside flow-through bores 10*a*, 10*b* of the other header pipe 4, and the outlet connector block 6. Heat-exchange efficiently takes place between first fluid in the tubes and second fluid passing across the outsides of the tubes 2.

With the presently filed embodiment, since the distal end surface 8*a* of the in-pipe 8 of the inlet connector block 5 has the surface area nearly equal to the total surface area of the opening surfaces 10*c*, 10*d* of the pipe-inside flow-through bores 10*a*, 10*b* of the header pipe 4, first fluid uniformly enters the pipe-inside flow-through bores 10*a*, 10*b*. Also, since the distal end surface 9*a* of the out-pipe 9 of the outlet connector block 6 has the surface area nearly equal to the total surface area of the opening surfaces 10*c*, 10*d* of the pipe-inside flow-through bores 10*a*, 10*b* of the header pipe 4, first fluid smoothly flows out from the pipe-inside flow-through bores 10*a*, 10*b*.

With the presently filed embodiment, the end of the block connector bore 12 is open to the pipe-inside flow-through bores 10*a*, 10*b*, only one block connector bore 12 may be provided in the header pipe 4. Therefore, an easy connecting structure may be provided between the one header pipe 4 and the inlet connector block 5.

With the presently filed embodiment, the distal end surface 8*a* of the in-pipe 8 is inserted to the position in front of the end face 11*a* formed by cutting out the partition wall 11 and the distal end surface 8*a* of the in-pipe 8 is made open to the pipe-inside flow-through bores 10*a*, 10*b*. Therefore, the in-pipe 8 is connected to the pipe-inside flow-through bores 10*a*, 10*b* without machining the distal end of the in-pipe 8.

With the presently filed embodiment, since the connecting structure between the outlet connector block 6 and the other header pipe 4 takes the same structure as that of the inlet side, it is possible for the outlet side to have the same advantage as that of the inlet side. Therefore, assembling work can be done with no distinction between the inlet connector block 5 and the outlet connector block 6, providing an ease of manufacturing the heat exchanger 1A.

Figure 9:
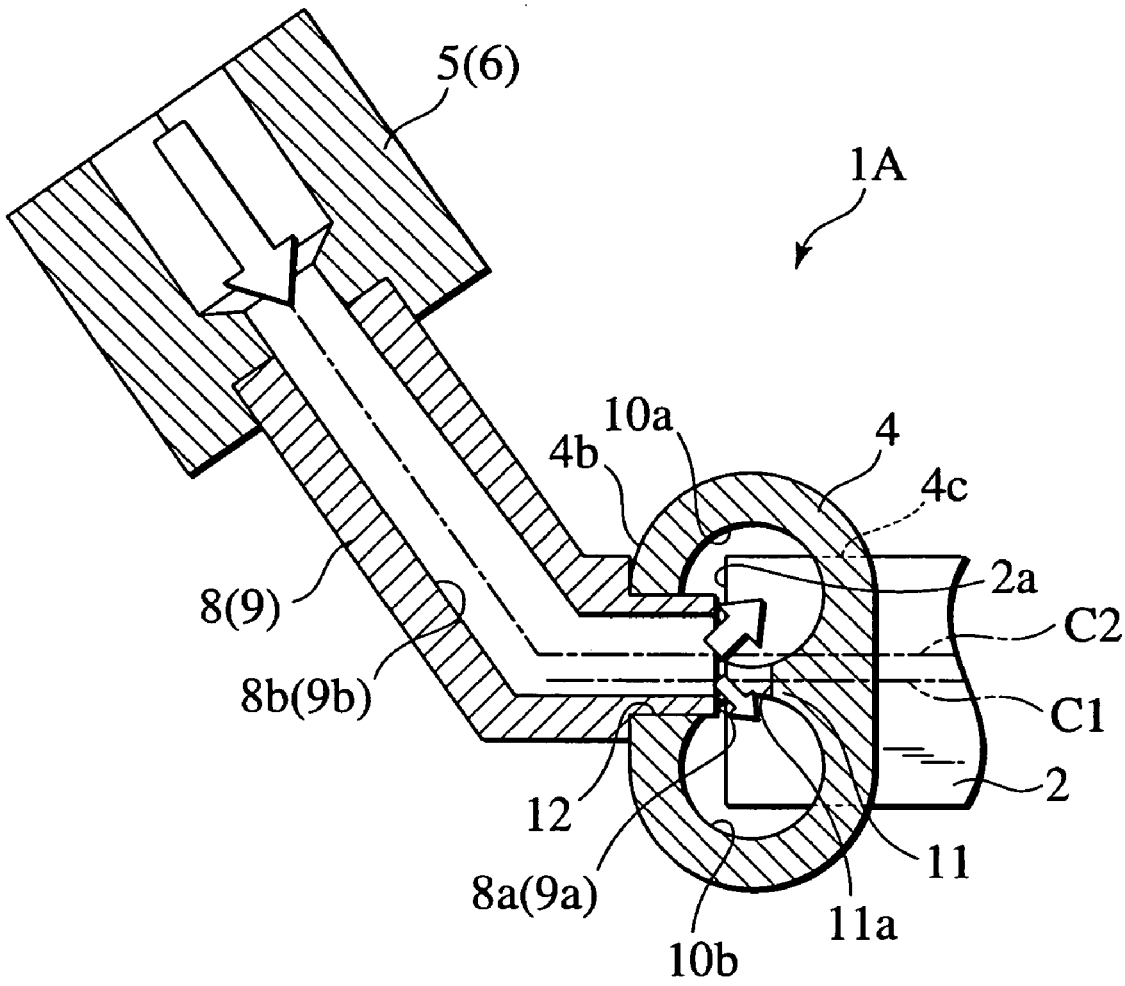
FIG. 9 is a cross sectional view illustrating a connecting portion between an inlet connector block and an header pipe in a first modified form of the heat exchanger of the first embodiment according to the present invention.

A first modified form of the presently filed embodiment is described. As shown in FIG. 9, the block connector bore 12 is formed in the header pipe 4 to cause the centerline C2 of the block connector bore 12 to be displaced toward the pipe-inside flow-through bore 10*a* with respect to the centerline C1 of the partition wall 11. With such a structure, an opening surface area of the pipe-inside flow-through bore 10*a* is set to be greater than an opening surface area of the pipe-inside flow-through bore 10*b*. Therefore, the flow distribution ratio of first fluid to be split to the pipe-inside flow-through bores 10*a*, 10*b* can be altered. Thus, by shifting the center of the block connector bore 12 rightward or leftward with respect to the center of the partition wall 11, since the opening surfaces areas of the pipe-inside flow-through bores 10*a*, 10*b* are altered, a flow distribution ratio with respect to the pipe-inside flow-through bores 10*a*, 10*b* can be easily altered. Further, this modification may also be applied to the connecting mechanism between the outlet connector block and the header pipe 4.

Figure 10A:
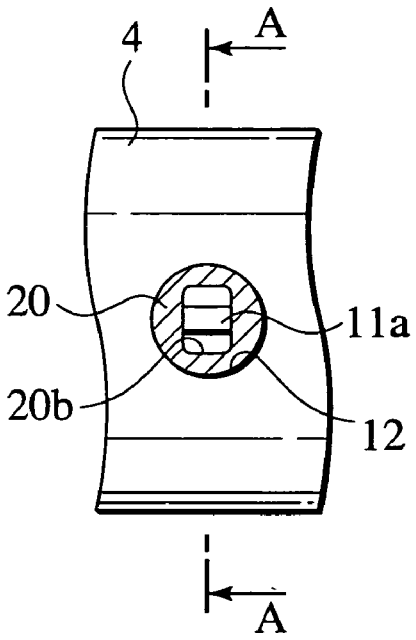
FIG. 10A is a front view of an essential part of the header pipe, to which an in-pipe is inserted, in a second modified form of the heat exchanger of the first embodiment according to the present invention.
Figure 10B:
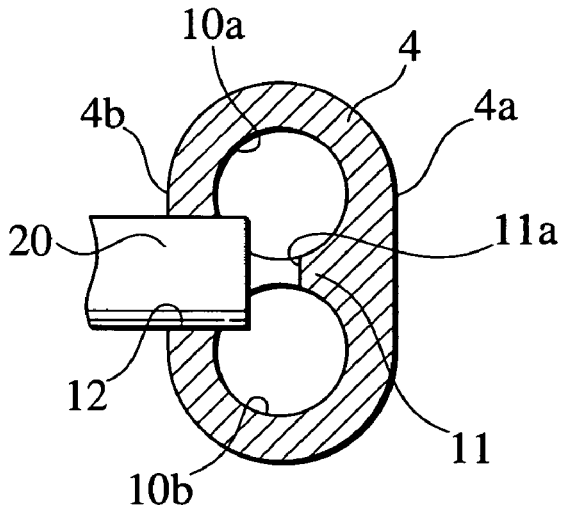
FIG. 10B is a cross sectional view taken on line A—A of FIG. 10A.

A second modified form of the presently filed embodiment is described. As shown in FIGS. 10A and 10B, a communicating bore 20*b* inside of an in-pipe 20 is formed in a square-shaped cross section. Followed by this configuration, the block connector bore 12 may be formed in a square-shape cross section. This shape results in improvement in a pressure tightness of the header pipe 4.

Figure 11:
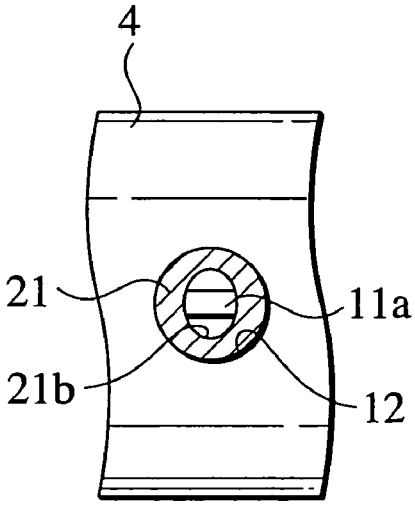
FIG. 11 is a front view of an essential part of a header pipe, to which an in-pipe is inserted, in a third modified form of the heat exchanger of the first embodiment according to the present invention.

A third modified form of the presently filed embodiment is described. As shown in FIG. 11, a communicating bore 21*b* inside of an in-pipe 21 is formed in an elliptical shape cross section (in an elliptical shape). Followed by this configuration, the block connector bore 12 may be formed in an elliptical shape cross section (in an elliptical shape). This shape results in improvement in a pressure tightness of the header pipe 4.

Second Embodiment

A heat exchanger 1B has a structure different from the heat exchanger 1A in respect of the connecting structure between the inlet connector block 5 and one of the header pipes 4, and the connecting structure between the outlet connector block 6 and the other header pipe 4. Since the heat exchanger 1B has the same structure as the heat exchanger 1A except for the above structure, description of the other component parts is omitted. Also, the same component parts as those of the heat exchanger 1A bear the same reference numerals as those of the heat exchanger 1B in the drawings.

Figure 12:
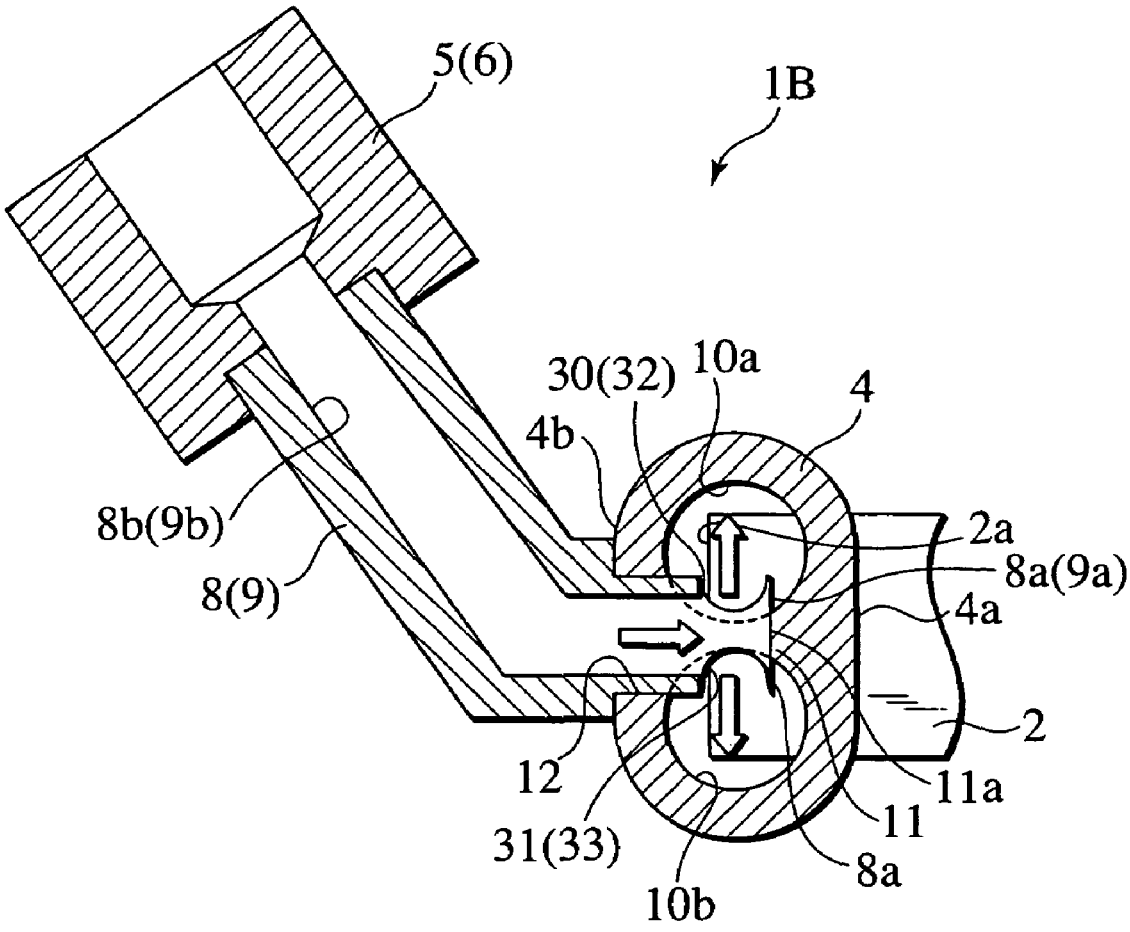
FIG. 12 is a cross sectional view illustrating a connecting portion between an inlet connector block and a header pipe in a heat exchanger of a second embodiment of the present invention.
Figure 13:
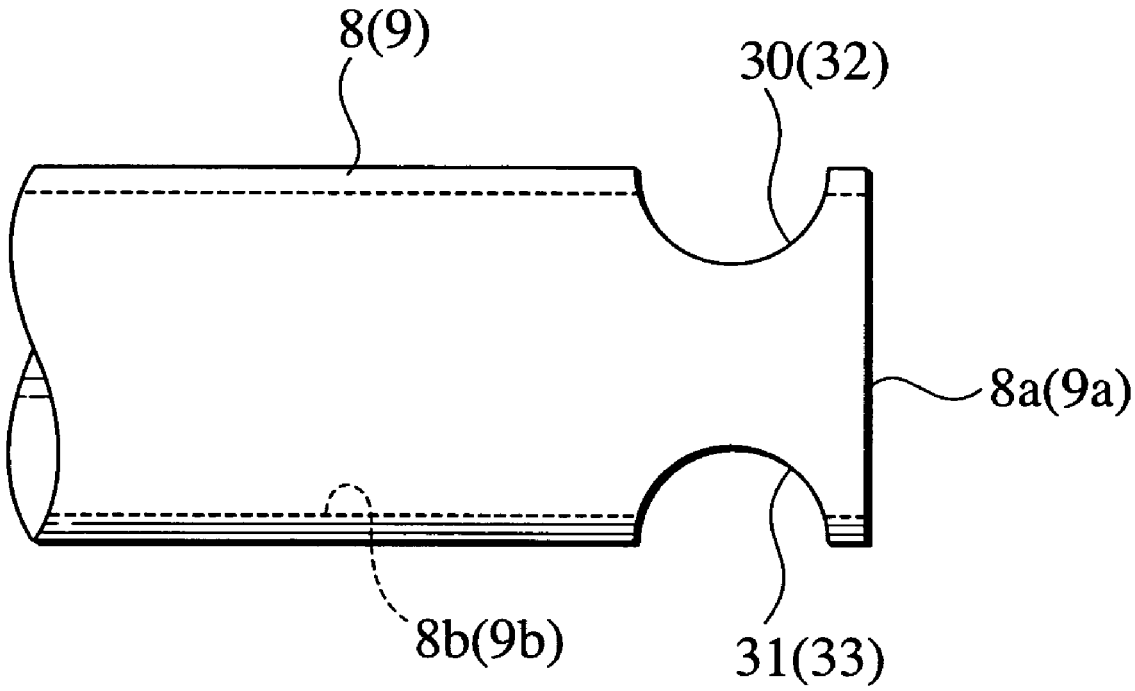
FIG. 13 is an enlarged front view of a distal end of an in-pipe in the heat exchanger of the second embodiment of the second embodiment.

As shown in FIGS. 12 and 13, the in-pipe 8 has a distal end surface 8*a* that is closed, and a peripheral wall of the distal end portion of the in-pipe 8 is formed with bores 30, 31. The bores 30, 31 are open to the communicating bore 8*b* of the in-pipe 8. The in-pipe 8 is inserted until the distal end surface 8*a* of the in-pipe 8 is brought into abutting engagement with the end face 11*a* formed by cutting out the partition wall 11. Under such a condition, the bores 30, 31 are open to the pipe-inside flow-through bores 10*a*, 10*b*, respectively. With such a structure, the inlet connector block 5 is connected to one of the header pipes 4.

Likewise, the out-pipe 9 has a distal end surface 9*a* that is closed, and a peripheral wall of the distal end portion of the out-pipe 9 is formed with bores 32, 33. The bores 32, 33 are open to the communicating bore 9*b* of the out-pipe 9. The out-pipe 9 is inserted until the distal end surface 9*a* of the out-pipe 9 is brought into abutting engagement with the end face 11*a* formed by cutting out the partition wall 11. Under such a condition, the bores 32, 33 are open to the pipe-inside flow-through bores 10*a*, 10*b*, respectively. With such a structure, the outlet connector block 6 is connected to the other header pipe 4.

With the presently filed embodiment, since an end portion of the block connector bore 12 is open to the pipe-inside flow-through bores 10*a*, 10*b*, it is sufficient for the header pipe 4 to be formed with one block connector bore 12. Further, if the diameters of the bores 30, 31 of the in-pipe 8 are changed, the opening surface areas of the pipe-inside flow-through bores 10*a*, 10*b* vary. Therefore, the connecting structure between the one header pipe 4 and the inlet connector block 5 is simplified, and the flow distribution ratio of fluid to be distributed to the pipe-inside flow-through bores 10*a*, 10*b* can be easily altered.

With the presently filed embodiment, the distal end surface 8*a* of the in-pipe 8 is closed, whereupon the in-pipe 8 is inserted until the distal end surface 8*a* is brought into abutting engagement with the end face 11*a* formed by cutting out the partition wall 11 and the bores 30, 31 formed on the side periphery of the distal end portion of the in-pipe 8 are open to the pipe-inside flow-through bores 10*a*, 10*b*, respectively. Therefore, the in-pipe 8 may be sufficiently inserted until the distal end surface 8*a* of the in-pipe 8 is brought into abutting engagement with the end face 11*a* of the partition wall 11, and positioning of the in-pipe 8 can be reliably and easily performed, resulting in improvement over an insertion workability.

With the presently filed embodiment, since the connecting structure between the outlet connector block 6 and the other header pipe 4 has the same structure as that of the inlet side, the same effect as that of the inlet side can be obtained. Therefore, assembling work can be performed without distinction between the inlet connector block 5 and the outlet connector block 6, resulting in an ease of manufacturing the heat exchanger 1B.

What is claimed is:

1. A heat exchanger comprising:

a plurality of tubes internally having tube-inside flow-through bores;

a first header pipe comprising:

a first partition wall that is internally formed;

a first pipe-inside flow-through bore portion that is internally formed and divided into two regions by the first partition wall; and a first tube insertion bore portion formed on a first area of a side wall in slit shapes to accommodate first end portions of the tubes;

a second header pipe comprising:

a second partition wall that is internally formed;

a second pipe-inside flow-through bore portion that is internally formed and divided into two regions by the second partition wall; and a second tube insertion bore portion formed on a first area of a side wall in slit shapes to accommodate second end portions of the tubes;

a first connector bore portion formed on the side wall of the first header pipe at a second area opposing to the first area and on the first partition wall at an area opposing to the second area, and opening to the two regions of the first pipe-inside flow-though bore portion;

a second connector bore portion formed on the side wall of the second header pipe at a second area opposing to the first area and on the second partition wall at an area opposing to the second area, and opening to the two regions of the second pipe-inside flow-though bore portion;

an inlet connector block having one end portion accommodated in the first connector bore portion and permitting coolant to flow through the first pipe-inside flow-through bore portion; and an outlet connector block having one end portion accommodated in the second connector bore portion and permitting the coolant to flow out through the second pipe-inside flow-through bore portion wherein the distal end surface of the end portion of the inlet connector block is closed, and the side wall of the end portion of the inlet connector block has a plurality of bore portions.

2. The heat exchanger according to claim 1, wherein in an inside of the first connector bore portion, a distal end surface of the end portion of the inlet connector block is inserted to be in abutting engagement with an end face of the first connector bore portion on the partition wall side, and the bore portions are open to the two regions of the first pipe-inside flow-through bore portion.

3. The heat exchanger according to claim 1, wherein the end portion of the inlet connector block includes an in-pipe.

4. The heat exchanger according to claim 3, wherein the in-pipe internally has a communicating bore formed in a circular cross section.

5. The heat exchanger according to claim 3, wherein the in-pipe internally has a communicating bore formed in a rectangular cross section.

6. The heat exchanger according to claim 3, wherein the in-pipe internally has a communicating bore formed in an elliptical cross section.

7. The heat exchanger according to claim 1, wherein the end portion of the outlet connector block includes an out-pipe.

8. The heat exchanger according to claim 7, wherein the out-pipe internally has a communicating bore formed in a circular cross section.

9. The heat exchanger according to claim 7, wherein the out-pipe internally has a communicating bore formed in a rectangular cross section.

10. The heat exchanger according to claim 7, wherein the out-pipe internally has a communicating bore formed in an elliptical cross section.

11. A heat exchanger comprising:

a plurality of tubes internally having tube-inside flow-through bores;

a first header pipe comprising:

a first partition wall that is internally formed;

a first pipe-inside flow-through bore portion that is internally formed and divided into two regions by the first partition wall; and a first tube insertion bore portion formed on a first area of a side wall in slit shapes to accommodate first end portions of the tubes;

a second header pipe comprising:

a second partition wall that is internally formed;

a second pipe-inside flow-through bore portion that is internally formed and divided into two regions by the second partition wall; and a second tube insertion bore portion formed on a first area of a side wall in slit shapes to accommodate second end portions of the tubes;

a first connector bore portion formed on the side wall of the first header pipe at a second area opposing to the first area and on the first partition wall at an area opposing to the second area, and opening to the two regions of the first pipe-inside flow-though bore portion;

a second connector bore portion formed on the side wall of the second header pipe at a second area opposing to the first area and on the second partition wall at an area opposing to the second area, and opening to the two regions of the second pipe-inside flow-though bore portion;

an inlet connector block having one end portion accommodated in the first connector bore portion and permitting coolant to flow through the first pipe-inside flow-through bore portion; and an outlet connector block having one end portion accommodated in the second connector bore portion and permitting the coolant to flow out through the second pipe-inside flow-through bore portion, wherein the distal end surface of the end portion of the outlet connector block is closed, and the side wall of the end portion of the outlet connector block has a plurality of bore portions.

12. The heat exchanger according to claim 11, wherein in an inside of the second connector bore portion, a distal end surface of the end portion of the outlet connector block is inserted to be in abutting engagement with an end face of the second connector bore portion on the partition wall side, and the bore portions are open to the two regions of the second pipe-inside flow-through bore portion.

* * * * *